US010991483B2

(12) United States Patent
Ikeda et al.

(10) Patent No.: US 10,991,483 B2
(45) Date of Patent: Apr. 27, 2021

(54) ASSEMBLED WIRE, METHOD OF PRODUCING THE SAME, AND ELECTRICAL EQUIPMENT USING THE SAME

(71) Applicant: ESSEX FURUKAWA MAGNET WIRE JAPAN CO., LTD., Tokyo (JP)

(72) Inventors: Keisuke Ikeda, Tokyo (JP); Hideo Fukuda, Tokyo (JP)

(73) Assignee: ESSEX FURUKAWA MAGNET WIRE JAPAN CO., LTD., Tokyo (JP)

( * ) Notice: Subject to any disclaimer, the term of this patent is extended or adjusted under 35 U.S.C. 154(b) by 0 days.

(21) Appl. No.: 15/982,751

(22) Filed: May 17, 2018

(65) Prior Publication Data

US 2018/0268962 A1 Sep. 20, 2018

Related U.S. Application Data

(63) Continuation of application No. PCT/JP2016/083815, filed on Nov. 15, 2016.

(30) Foreign Application Priority Data

Nov. 20, 2015 (JP) ..... JP2015-227868

(51) Int. Cl.
*H01B 7/02* (2006.01)
*H01B 7/30* (2006.01)
(Continued)

(52) U.S. Cl.
CPC ..... *H01B 7/303* (2013.01); *H01B 7/00* (2013.01); *H01B 7/02* (2013.01); *H01B 7/0225* (2013.01);
(Continued)

(58) Field of Classification Search
CPC ..... H01B 7/0208; H01B 7/08; H02K 3/04
(Continued)

(56) References Cited

U.S. PATENT DOCUMENTS 3,202,558 A * 8/1965 Gottung ..... H02K 3/34 156/56
3,702,499 A * 11/1972 Virsbreg ..... H01F 41/06 174/DIG. 8
(Continued)

FOREIGN PATENT DOCUMENTS

CN 201307453 * 9/2009
CN 201984898 * 9/2011
(Continued)

OTHER PUBLICATIONS

International Search Report issued in PCT/JP2016/083815 (PCT/ISA/210), dated Jan. 31, 2017.
(Continued)

*Primary Examiner* — Chau N Nguyen
(74) *Attorney, Agent, or Firm* — Birch, Stewart, Kolasch & Birch, LLP

(57) ABSTRACT

An assembled wire, having: an assembled conductor composed of a plurality of conductor strands each having a rectangular cross-section, stacked and arranged each other across an interlayer insulating layer; an insulating outer layer that coats the assembled conductor including the interlayer insulating layer; and an adhesion layer composed of a thermoplastic resin having a thickness of 3 μm or more and 10 μm or less between the assembled conductor and the insulating outer layer.

7 Claims, 3 Drawing Sheets

(51) Int. Cl.

| | |
|---|---|
| ***H01B 13/00*** | (2006.01) |
| ***H01B 7/00*** | (2006.01) |
| ***H01B 13/14*** | (2006.01) |
| *H01B 3/42* | (2006.01) |
| *H01R 4/02* | (2006.01) |
| *H01R 4/70* | (2006.01) |

(52) U.S. Cl.
CPC ..... *H01B 7/0275* (2013.01); *H01B 13/00* (2013.01); *H01B 13/0013* (2013.01); *H01B 13/14* (2013.01); *H01B 3/427* (2013.01); *H01R 4/023* (2013.01); *H01R 4/70* (2013.01)

(58) Field of Classification Search
USPC ..... 174/120 R, 128.1, 117 R; 310/201, 208
See application file for complete search history.

(56) References Cited

U.S. PATENT DOCUMENTS

| | | | | | |
|---|---|---|---|---|---|
| 4,204,087 | A * | 5/1980 | Lin | H01B 13/0033 | 174/119 R |
| 4,321,426 | A * | 3/1982 | Schaeffer | H01F 27/323 | 174/34 |
| 4,552,990 | A * | 11/1985 | Persson | H01F 27/2823 | 174/117 FF |
| 5,099,159 | A * | 3/1992 | Liptak | H02K 3/34 | 174/120 SR |
| 5,393,933 | A * | 2/1995 | Goertz | H01B 7/0018 | 174/102 R |
| 7,759,834 | B2 * | 7/2010 | Onimaru | H02K 3/14 | 310/201 |
| 8,669,473 | B2 * | 3/2014 | Ikeda | H01B 3/04 | 174/110 R |
| 2006/0106139 | A1 * | 5/2006 | Kosaka | C08L 23/02 | 524/90 |
| 2010/0056623 | A1 * | 3/2010 | Lee | C07D 303/28 | 514/475 |
| 2011/0056623 | A1 * | 3/2011 | Im | C08L 75/14 | 156/275.5 |
| 2011/0226508 | A1 * | 9/2011 | Aoi | C08L 81/02 | 174/120 SR |
| 2015/0021067 | A1 | 1/2015 | Muto et al. | | |
| 2015/0310959 | A1 | 10/2015 | Oya et al. | | |
| 2016/0189824 | A1 | 6/2016 | Fukuda et al. | | |
| 2016/0189826 | A1 | 6/2016 | Fukuda et al. | | |

FOREIGN PATENT DOCUMENTS

| | | | |
|---|---|---|---|
| CN | 104170024 | A | 11/2014 |
| CN | 104185879 | A | 12/2014 |
| EP | 2328154 | A1 | 6/2011 |
| JP | 2007-18732 | A | 1/2007 |
| JP | 2008-186724 | A | 8/2008 |
| JP | 2008-193860 | A | 8/2008 |
| JP | 2009-245666 | A | 10/2009 |
| TW | 201523651 | A | 6/2015 |
| WO | WO 98/14964 | * | 4/1998 |
| WO | WO 2015/033821 | A1 | 3/2015 |

OTHER PUBLICATIONS

Written Opinion of the International Searching Autority issued in PCT/JP2016/083815 (PCT/ISA/237), dated Jan. 31, 2017.
Extended European Search Report, dated Jun. 7, 2019, for European Application No. 16866310.2.
Chinese Office Action and Search Report, dated Apr. 18, 2019, for Chinese Application No. 201680066119.6, along with an English translation.

* cited by examiner

ASSEMBLED WIRE, METHOD OF PRODUCING THE SAME, AND ELECTRICAL EQUIPMENT USING THE SAME

CROSS-REFERENCE TO RELATED APPLICATIONS

This application is a Continuation of PCT International Application No. PCT/JP2016/083815 filed on Nov. 15, 2016, which claims priority under 35 U.S.C. § 119 (a) to Japanese Patent Application No. 2015-227868 filed in Japan on Nov. 20, 2015. Each of the above applications is hereby expressly incorporated by reference, in its entirety, into the present application.

TECHNICAL FIELD

The present invention relates to an assembled wire, which is composed by stacking a plurality of rectangular metallic bodies, and which is mainly intended for a high-frequency application; and further the present invention relates to a method of producing the same, and an electrical equipment using the same.

BACKGROUND ART

In general, the high-frequency rectangular wire is used for coils, and the like, of the AC motor and the high-frequency electrical equipment. This is also applied to motors for a high-speed railroad vehicle, in addition to motors for a hybrid vehicle (HV) and an electric vehicle (EV). Conventional rectangular wires are composed by stacking rectangular metallic bodies each having a rectangular shape of a cross-section and an insulating enamel coating or oxide coating formed on the outer periphery of the rectangular metallic body. Further, as rectangular wires without any enamel coating, there are known those which are composed by stacking rectangular metallic bodies each having a rectangular cross-section and having a bonding thermosetting resin coating or an oxide coating formed on the outer periphery thereof. For example, there is disclosed an assembled conductor having an adhesion layer of an insulating thermosetting resins interposed between conductors (for example, see Patent Literature 1). Further, there is disclosed a rectangular wire, which is composed by stacking rectangular metallic conductors having an oxide coating formed on the outer periphery of the conductor and by covering the stacked conductor bodies with an insulating layer (for example, see Patent Literature 2).

CITATION LIST

Patent Literatures

Patent Literature 1: JP-A-2008-186724 ("JP-A" means unexamined published Japanese patent application)
Patent Literature 2: JP-A-2009-245666

SUMMARY OF INVENTION

Technical Problem

In the conventional high-frequency rectangular wires, which are composed by stacking a plurality of rectangular metallic bodies having an insulating enamel coating formed on the outer periphery thereof, high-frequency property is developed by stacking the rectangular metallic conductors. However, the enamel coating remains as soot, at the welding step in assembling of a motor. As a result, the soot made it difficult to rigidly weld. Further, in the rectangular wire without any enamel coating, a good weldability can be obtained. However, there was room for improvement in adhesiveness between each of the rectangular metallic conductors in the bending work.

The present invention is contemplated for allowing a rigid welding while satisfying high-frequency property, and for securing adhesiveness between a conductor strand and an insulating outer layer stacked on the conductor. Further, the present invention is contemplated for providing an assembled wire improved in bending workability, a method of producing the same, and an electrical equipment using the same.

Solution to Problem

The above-described problems of the present invention are solved by the following means:

(1) An assembled wire, comprising: an assembled conductor composed of a plurality of conductor strands each having a rectangular cross-section, stacked and arranged each other across an interlayer insulating layer; and an insulating outer layer that coats the assembled conductor including the interlayer insulating layer; and further comprising: an adhesion layer composed of a thermoplastic resin having a thickness of 3 μm or more and 10 μm or less between the assembled conductor and the insulating outer layer.

(2) The assembled wire as described in the item (1), wherein the adhesion layer is composed of a thermoplastic resin having a tensile modulus at 250° C. of 10 MPa or more and 1,000 MPa or less.

(3) The assembled wire as described in the item (1) or (2), wherein the adhesion layer is composed of: an amorphous resin having a glass transition temperature of 200° C. or more and 300° C. or less; or a thermoplastic resin having a melting point of 250° C. or more and 350° C. or less.

(4) The assembled wire as described in any one of the items (1) to (3), wherein the adhesion layer is composed of a resin selected from the group consisting of polyetherimide (PEI), polyethersulfone (PES), and polyphenyl sulfone (PPSU).

(5) The assembled wire as described in any one of the items (1) to (4), wherein the adhesion layer is comprised of a single layer or a plurality of layers (multi-layers).

(6) The assembled wire as described in any one of the items (1) to (5), wherein the interlayer insulating layer is composed of a thermoplastic resin having a melting point of 250° C. or more and 350° C. or less.

(7) The assembled wire as described in any one of the items (1) to (6), wherein the interlayer insulating layer is composed of a resin selected from the group consisting of polyethylene terephthalate (PET), polyethylene naphthalate (PEN), polyamide 6T (PA6T), and polyamide 9T (PA9T).

(8) The assembled wire as described in any one of the items (1) to (7), wherein the interlayer insulating layer is composed of a thermoplastic resin having a melting point of 270° C. or more.

(9) The assembled wire as described in any one of the items (1) to (8), wherein the interlayer insulating layer is composed of a resin selected from the group consisting of polyphenylenesulfide (PPS), polyetheretherketone (PEEK), modified polyetheretherketone (modified PEEK), and thermoplastic polyimide.

(10) The assembled wire as described in any one of the items (1) to (9), wherein the number of stacked layers of conductor strands is two layers or more and six layers or less.

(11) A method of producing an assembled wire, comprising:

a step of forming an assembled conductor, by stacking, in a thickness direction, each of conductor strands having a rectangular cross-section and having an interlayer insulating layer of a thermoplastic resin of an amorphous resin having no melting point or a thermoplastic resin of a crystalline resin having an amide bond, formed on one side thereof by performing bake-finishing;

a step of coating an adhesion layer of a thermoplastic resin on the outer periphery of the assembled conductor; and a step of coating an insulating outer layer on the outer periphery of the adhesion layer, wherein, before coating the insulating outer layer, an adhesion layer, which has a thickness of 3 μm or more and 10 μm or less, is formed on the outer periphery of the assembled conductor.

(12) An electrical equipment, having wirings, wherein at least a part of the wirings comprises: an assembled conductor composed of a plurality of conductor strands each having a rectangular cross-section, stacked and arranged each other across an interlayer insulating layer; and an insulating outer layer that coats the assembled conductor including the interlayer insulating layer; and further comprises: an adhesion layer composed of a thermoplastic resin having a thickness of 3 μm or more and 10 μm or less between the assembled conductor and the insulating outer layer.

Effects of Invention

The assembled wire of the present invention has an interlayer insulating layer between stacked conductor strands. Further, an insulating outer layer is formed on the outer periphery of the stacked conductor strands through an adhesion layer of a thermoplastic resin. This allows suppression of high-frequency loss. With this, by the lack of weld-generated soot, a rigid weld is enabled and an easier weld can be achieved in combination with the rigid weld. Further, with the adhesion layer, adhesiveness between an insulating outer layer and an assembled conductor is enhanced, and thereby a bending workability of the assembled wire can be enhanced.

The method of producing an assembled wire according to the present invention allows provision of production of an assembled wire which exhibits an excellent high-frequency property, ease of welding and bending work.

The electrical equipment of the present invention exhibits an excellent high-frequency property, together with a high reliance of wire jointing because the assembled wire of the present invention is excellent in welding property and bending work.

Other and further features and advantages of the invention will appear more fully from the following description, appropriately referring to the accompanying drawings.

Each of FIGS. 3(*a*), 3(*b*), 3(*c*), and 3(*d*) is a figure showing evaluation of the welding property. In the figures, FIG. 3(*a*) is a perspective view showing an example which exhibits excellent welding property, FIG. 3(*b*) is a perspective view showing an example in which the welding is possible, FIG. 3(*c*) is a perspective view showing an example which provides a poor welding property, and FIG. 3(*d*) is a perspective view showing an example in which the welding became impossible.

Each of FIGS. 4(*a*), 4(*b*), 4(*c*), and 4(*d*) is a figure showing evaluation of the molding property. In the figures, FIG. 4(*a*) is a cross-section view showing an example which exhibits excellent molding property, FIG. 4(*b*) is a cross-section view showing an example which exhibits a good molding property, FIG. 4(*c*) is a cross-section view showing an example in which the molding property is in an acceptable range, and FIG. 4(*d*) is a cross-section view showing an example which provides a poor molding property. Note, however, that indication of the hatching showing the cross-section was omitted.

MODE FOR CARRYING OUT THE INVENTION

With regard to the assembled wire of the present invention, one of preferable embodiments is described with reference to FIG. 1.

Figure 1:
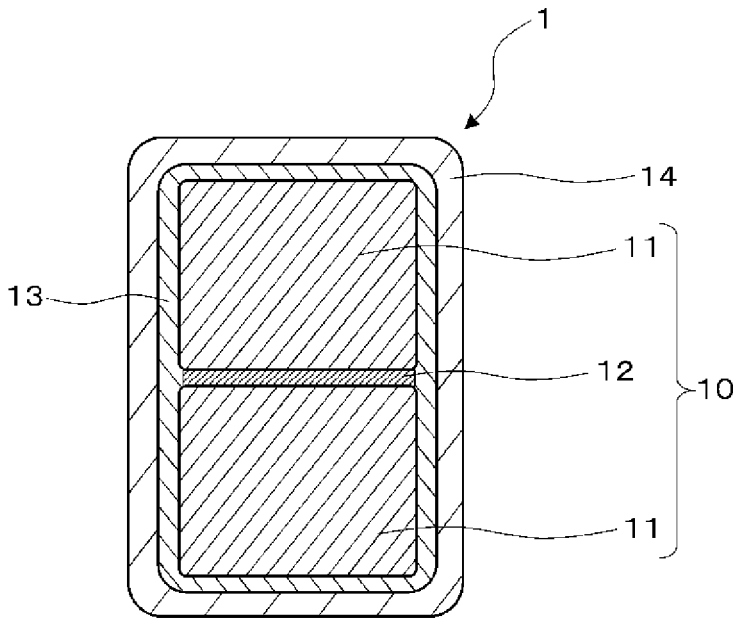
FIG. 1 is a cross-section view showing one of preferable embodiments related to the assembled wire of the present invention.

As shown in FIG. 1, an assembled wire 1 has an assembled conductor 10 in which a plurality of conductor strands 11 each having a rectangular cross-section are stacked and arranged. In the drawing, as one example, the assembled wire 1 having two layers of stacked conductor strands 11 was shown. An interlayer insulating layer 12 is interposed between the above-described conductor strand 11 and conductor strand 11. The assembled conductor 10 is coated with an insulating outer layer 14 through an adhesion layer 13 of a thermoplastic resin.

(Conductor Strand)

The conductor strand 11 of the above-described assembled wire 1 has a rectangular cross-section and those used in the conventional assembled wires (rectangular wires) can be used. The above-described rectangular cross-section means a rectangle-shaped cross-section and includes those having a round at a corner of the rectangle. Preferred examples of the conductor strand 11 include conductors of a low-oxygen copper whose oxygen content is 30 ppm or less, or an oxygen-free copper. In a case where the conductor strand 11 is melted by heat for the purpose of welding if the oxygen content is low, voids caused by contained oxygen are not occurred at a welded portion, the deterioration of the electrical resistance of the welded portion can be prevented, and the strength of the welded portion can be secured.

(Interlayer Insulating Layer Between Conductor Strands)

In the interlayer insulating layer 12 between the two conductor strands 11, a thermoplastic resin having a melting point of 250° C. or more and 350° C. or less is used. If the melting point of the interlayer insulating layer 12 is too low, electric characteristics in the heat resistance test get worse. On the other hand, if the melting point of the interlayer insulating layer 12 is too high, there is a possibility that the interlayer insulating layer remains not to be fully melted on the occasion of weld and thereby weldability gets worse. The interlayer insulating layer 12 is selected from the group consisting of polyethylene terephthalate, polyethylene naphthalate, polyamide 6T, and polyamide 9T. The polyethylene terephthalate (PET) has a melting point of 252° C., and the polyethylene naphthalate (PEN) has a melting point of 265°

C. The polyamide 6T (PA6T) has a melting point of 320° C., and the polyamide 9T (PA9T) has a melting point of 300° C.

The interlayer insulating layer 12 is an insulating layer for preventing contact between the two conductor strands 11, and is formed between opposing sides of the two conductor strands 11.

(Adhesion Layer on the Periphery of Assembled Conductor)

The adhesion layer 13 has a tensile modulus whereby, when the assembled wire 1 is subjected to bending work, a stacking condition of the two conductor strands 11 can be maintained without any misalignment. The tensile modulus at 250° C. of the adhesion layer 13 is 10 MPa or more and 1,000 MPa or less, preferably 50 MPa or more and 500 MPa or less, and more preferably 100 MPa or more and 200 MPa or less. The tensile modulus is a value obtained by dividing a tensile stress to which a material is subjected within the limitation of elasticity by a distortion caused in the material. With an increase in this value, the deformation of an assembled wire 1 against a burden on the assembled wire 1 becomes smaller. If the tensile modulus is too low, when the assembled wire 1 is subjected to bending work, misalignment in the stacked state of the conductor strand 11 becomes large. On the other hand, if the tensile modulus is too high, when the assembled wire 1 is subjected to bending work, the assembled wire 1 becomes unpliable.

Further, the adhesion layer 13 is permissible, as long as it allows adhesiveness to both the conductor strand 11 and the insulating outer layer 14. Thus, the thickness of the adhesion layer 13 is 3 μm or more and 10 μm or less, preferably 3 μm or more and 8 μm or less, and further preferably 4 μm or more and 7 μm or less. If the adhesion layer 13 is too thin, when the assembled wire 1 is subjected to bending work, misalignment in the stacking state of the conductor strand 11 becomes large. Further, if the adhesion layer 13 is too thick, when the assembled wire 1 is subjected to bending work, the assembled wire 1 becomes unpliable.

The above-described adhesion layer 13 is composed of a thermoplastic resin, and examples thereof include amorphous resins having a glass transition temperature of 200° C. or more and 300° C. or less. If the glass transition temperature is too low, there is a possibility that electric characteristics get worse in the heat resistance test. On the other hand, if the glass transition temperature is too high, there is a possibility that the adhesion layer remains not to be fully melted on the occasion of weld and thereby weldability gets worse.

Examples of the amorphous resin include resins selected from the group consisting of polyetherimide, polyethersulfone, polyphenyl sulfone, and phenyl sulfone. The polyetherimide (PEI) has a tensile modulus of 100 MPa, and a glass transition temperature of 217° C. The polyethersulfone (PES) has a tensile modulus of 200 MPa, and a glass transition temperature of 225° C. The polyphenyl sulfone (PPSU) has a tensile modulus of 200 MPa, and a glass transition temperature of 220° C. The phenyl sulfone (PSU) has a tensile modulus of 30 MPa, and a glass transition temperature of 185° C.

Alternatively, in the adhesion layer 13, a thermoplastic resin having a melting point of 250° C. or more and 350° C. or less is adopted in order not to deform the interlayer insulating layer 12. If the melting point thereof is too low, there is a possibility that electric characteristics in the heat resistance test get worse. On the other hand, if the melting point thereof is too high, there is a possibility that the adhesion layer remains not to be fully melted on the occasion of weld and thereby weldability gets worse. Further, in order to suppress deformation of the above-described interlayer insulating layer 12, the glass transition temperature of the adhesion layer 13 is preferably not higher than the melting point of the interlayer insulating layer 12. Examples of the resin for this purpose include resins selected from the group consisting of PEI, PES, and PPSU.

Figure 2:
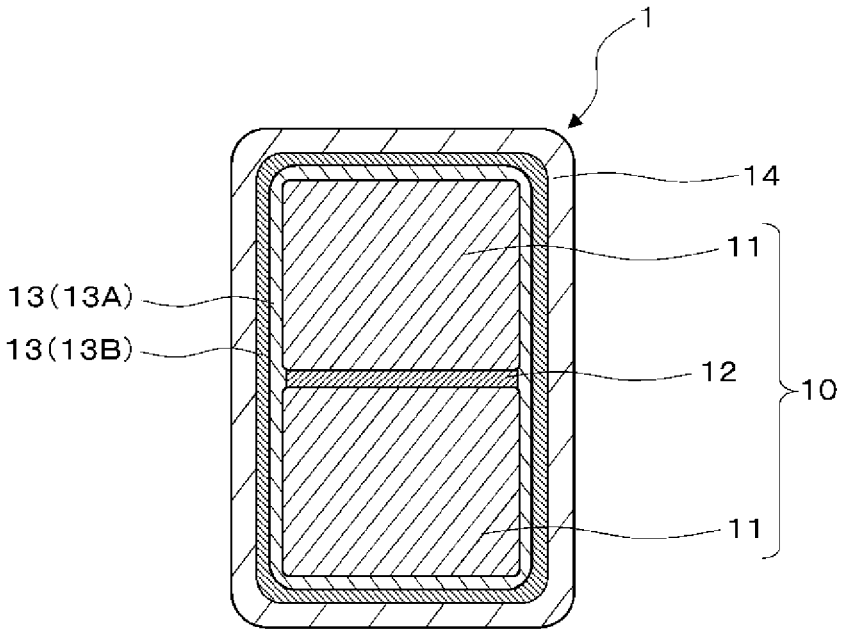
FIG. 2 is a cross-section view showing another of preferable embodiments related to the assembled wire of the present invention.
Figure 3A:
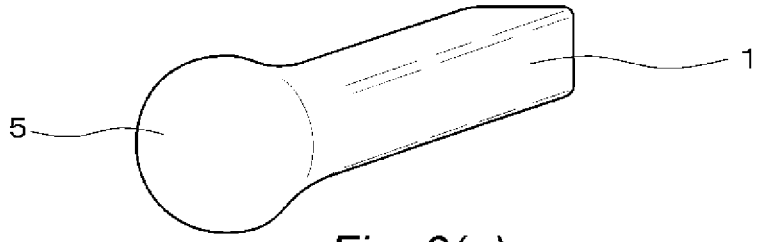
Figure 3B:
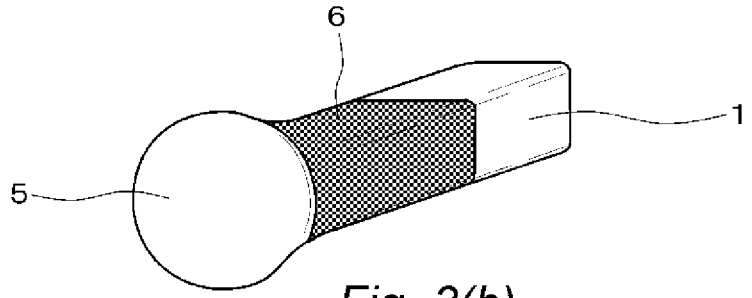
Figure 3C:
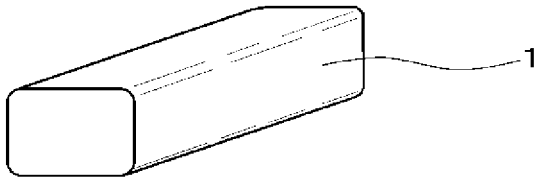
Figure 3D:
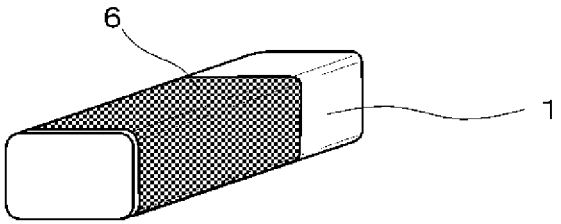
Figure 4A:
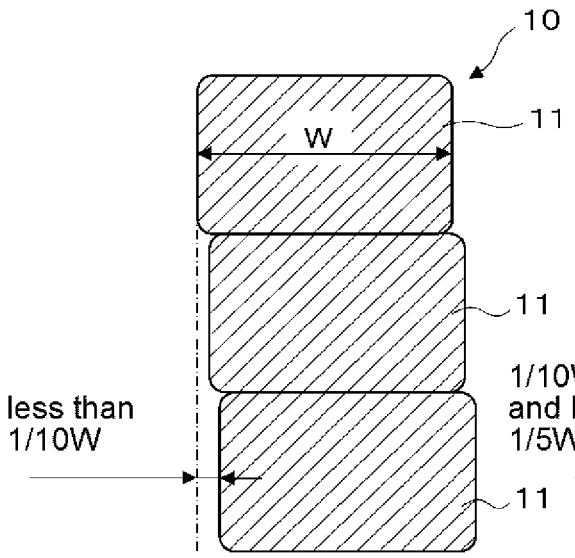
Figure 4B:
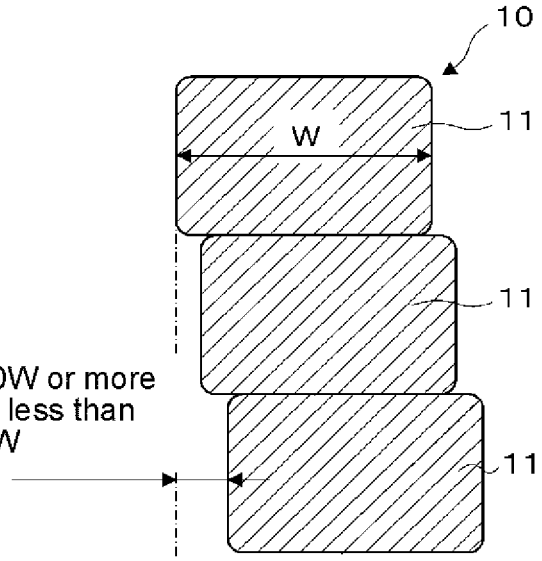
Figure 4C:
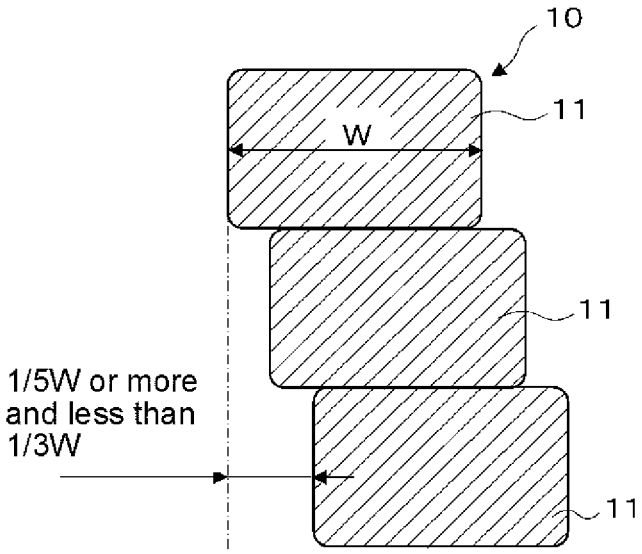
Figure 4D:
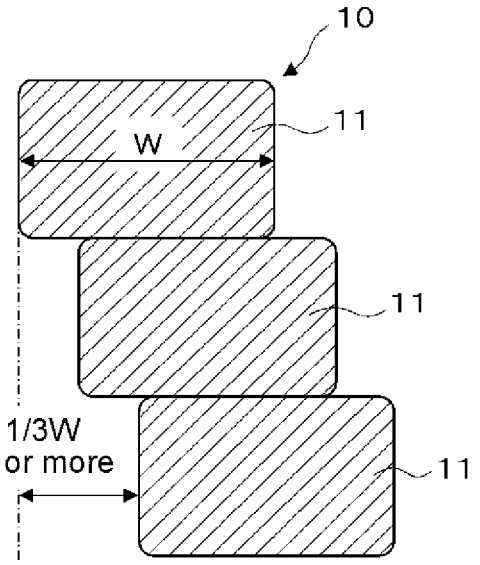

The above-described adhesion layer 13 may be formed into multi-layers. For example, as shown in FIG. 2, the assembled conductor 10 having the interlayer insulating layer 12 sandwiched between two conductor strands 11 may be covered with two layers of an adhesion layer 13A and an adhesion layer 13B. In the adhesion layer 13A, use is made of a thermoplastic resin that is excellent in adhesiveness with respect to the assembled conductor 10. Further, in the adhesion layer 13B, use is preferably made of a thermoplastic resin that is excellent in adhesiveness with respect to the insulating outer layer 14. Examples for the adhesion layer 13A include polyamide 9T (PA9T), polyetherimide (PEI), and the like. Examples for the adhesion layer 13B include PEI, polyphenyl sulfone (PPSU), polyethersulfone (PES), and the like. These resins are also excellent in adhesiveness between the adhesion layer 13A and the adhesion layer 13B. In this way, by making the adhesion layer 13 into two layers, more rigid adhesion force can be obtained. More specifically, a rigid adhesion is made possible, by the selection of: the above-described resin of the adhesion layer 13A which is excellent in adhesion with respect to the assembled conductor 10; and the above-described resin of the adhesion layer 13B which is excellent in adhesion with respect to the insulating outer layer 14.

(Insulating Outer Layer)

The insulating outer layer 14 is composed of a thermoplastic resin having a melting point of 270° C. or more. In order to prevent the above-described interlayer insulating layer 12 and adhesion layer 13 from change of properties, it is preferable that this melting point is set to be lower than the melting point of any of these resins. Examples thereof include resins selected from the group consisting of polyphenylenesulfide, polyetheretherketone, modified polyetheretherketone, and thermoplastic polyimide. The polyphenylenesulfide (PPS) has a melting point of 280° C. The polyetheretherketone (PEEK) has a melting point of 343° C. The modified polyetheretherketone (modified PEEK) has a melting point of 345° C. The thermoplastic polyimide has a melting point of 388° C.

The thickness of the insulating outer layer 14 is preferably 30 μm or more and 250 μm or less. If the thickness thereof is too thick, the insulating outer layer 14 becomes less effective in flexibility required for the assembled wire 1, because the insulating outer layer 14 itself has stiffness (hardness or rigidity). On the other hand, from the viewpoint that insulation failure can be prevented, the thickness of the insulating outer layer 14 is preferably 30 μm or more, more preferably 40 μm or more, and further preferably 50 μm or more. In this way, even though the insulating outer layer 14 has a certain thickness, since this layer is composed of a thermoplastic resin, generation of soot is suppressed on the occasion of weld, for example, arc weld and thereby a reduction in weldability due to soot can be prevented.

(The Number of Stacked Layers of Conductor Strands)

The number of stacked layers (the stacked layer number) of conductor strands 11 in the assembled conductors 10 is two layers or more and six layers or less. A decrease in the high-frequency loss can be fully appreciated even in the case where the number of layers to stack is two. As the number of the layers increases, the loss is more decreased. If the stacked layer number is one, the high-frequency loss becomes too much. On the other hand, if the stacked layer number is seven or more, the number of interlayer insulating layers 12 gets too much to bend it with ease, which results in lowering of moldability (workability). More specifically, misalignment in the stacked conductor strands 11 becomes easy to occur. In view of the above, it can be said to be realistic that the number of layers to stack is up to six, and preferable that the number of layers to stack is up to three.

Further, with regard to the direction to stack, whether the layers are stacked in any one of the direction of width (transverse) or thickness does not make any difference, provided that the longer side of the conductor strand 11 is defined as a width, and the shorter side thereof is defined as a thickness. Preferably, the conductor strand 11 is brought into contact with one another through their longer sides and is stacked in the thickness direction.

The assembled wire 1 of the present invention has an interlayer insulating layer 12, an adhesion layer 13 and an insulating outer layer 14, each of which is composed of a thermoplastic resin. For this reason, by suppressing generation of soot in the weld step, weld becomes easy to do, and this allows a rigid weld. Further, from the presence of the interlayer insulating layer between the conductor strands, the high-frequency loss can be suppressed. Further, from enhancement of the adhesiveness between the assembled conductor 10 and the insulating outer layer 14 by the adhesion layer 13, the assembled wire 1 is excellent in moldability. For this reason, even though the assembled wire 1 is bent, misalignment in the stacked conductor strands 11 can be suppressed. In other words, a bending workability can be enhanced.

To form the above-described interlayer insulating layer 12, a resin varnish containing a thermoplastic resin to be the interlayer insulating layer 12 is coated and baked on the conductor strand 11.

This baked layer of the thermoplastic resin can be formed by coating and baking a resin varnish containing a thermoplastic resin on only one of four outer peripheries of the conductor strand 11 having a rectangular cross-section. In this case, a desired constitution can be obtained, by masking the sides other than the side necessary for coating, and by coating the varnish only on the one necessary side. Specific baking conditions depend on the shape of a furnace to be used. For example, if the furnace is an about 5 m-sized vertical furnace by natural convection, the baking can be achieved by setting the passing time period to 10 to 90 sec at the temperature of 400 to 500° C.

To form the adhesion layer 13, it can be formed by preferably coating and baking a resin varnish containing a thermoplastic resin on the outer periphery of the assembled conductor 10. The method of coating the resin varnish may be in a usual manner. Examples of the coating method include a method of employing a die for a varnish coating, which has been manufactured so as to be similar to the shape of the assembled conductor 10; and a method of employing a die that is called "universal die", which has been formed in a curb shape, when the cross-sectional shape of the assembled conductor 10 is quadrangle. The assembled conductor 10 having the resin varnish coated thereon is baked by a baking furnace in a usual manner. Although specific baking conditions depend on the shape of a furnace to be used, in the case where the furnace is an about 5 m-sized vertical furnace by natural convection, the baking can be achieved by setting the passing time period to 10 to 90 sec at the furnace temperature of 400 to 500° C.

As the insulating outer layer 14, at least one layer or a plurality of layers is provided on the outside of the adhesion layer 13. The insulating outer layer 14 is supposed to strengthen an adhesion force with respect to the assembled conductor 10 by the adhesion layer 13.

A method of forming the foregoing insulating outer layer 14 is carried out by, for example, extrusion molding by using an extrusion-moldable thermoplastic resin. In this point, the thermoplastic resin has a melting point of 270° C. or more, preferably 300° C. or more, further preferably 330° C. or more. The upper limit of this melting point is 450° C. or less, preferably 420° C. or less, and further preferably 400° C. or less. This melting point can be determined with a differential scanning calorimeter (DSC). Further, such a thermoplastic resin is excellent in adhesion strength between the stacked multi-layer conductor member and the layer on the outer periphery of the stacked multi-layer conductor member and excellent in solvent resistance, in addition to anti-heat aging property.

The insulating outer layer 14 has relative permittivity of 4.5 or less, preferably 4.0 or less, and further preferably 3.8 or less, in that a partial discharge inception voltage can be more increased. The relative permittivity can be measured by a commercially available permittivity measurement device. The measuring temperature and frequency are changed as needed. In the present specification, the values measured at 25° C. and 50 Hz are adopted, unless otherwise specified.

Examples of the extrusion-moldable thermoplastic resin having relative permittivity of 4.5 or less include polyetheretherketone, a modified polyetheretherketone, a thermoplastic polyimide, and the like.

For the insulating outer layer 14, use may be, particularly preferably, made of any of thermoplastic resins having a melting point of 270° C. or more and 450° C. or less and having relative permittivity of 4.5 or less. As the thermoplastic resin, one kind may be used alone, or more than one kind may be used. In the case where at least two kinds are mixed and at least two kinds of melting points exist, if the at least two kinds of melting points include a resin having a melting point of 270° C. or more, the thus mixture in combination may be suitable. For example, use may be made of a polyaryletherketone (PAEK: melting point 343° C.) containing an aromatic ring, an ether bond and a ketone bond and which is represented by polyetheretherketone. Alternatively, use may be made of a modified PEEK (melting point 345° C.) in which other thermoplastic resin(s) is (are) mixed in PEEK. Alternatively, use may be made of at least one thermoplastic resin selected from the group consisting of PAEK, a modified PEEK, and a thermoplastic polyimide (TPI: melting point 388° C.). Further, the modified PEEK is, for example, a mixture in which polyphenylsulfone (PPSU) is added to PEEK, the mixing rate of PPSU being lower than PEEK.

The extrusion temperature conditions in extrusion molding of the insulating outer layer 14 are set adequately depending on the thermoplastic resin to be used. Stated as an example of a preferable extrusion temperature, specifically, in order to make the fusing viscosity appropriate for extrusion-coating, the extrusion temperature is set to a temperature higher than the melting point of the thermoplastic resin by about 40° C. to 60° C. In this way, the insulating outer layer 14 of the thermoplastic resin is formed by temperature-setting extrusion molding. In this case, in forming the insulating outer layer in the production process, it is not necessary to pass the insulating outer layer into a baking furnace, so that there is an advantage that the thickness of the insulating outer layer 14 can be thickened.

In the assembled wire 1 according to this preferable embodiment, the assembled conductor 10 and the adhesion layer 13 on the outer periphery thereof adhere to one another at a high strength of adhesion. Further, the adhesion strength between the adhesion layer 13 and the insulating outer layer 14 is high in adhesion. The adhesion strength between the assembled conductor 10 and the adhesion layer 13 on the outer periphery thereof, and the adhesion strength between the adhesion layer 13 and the insulating outer layer 14 are measured, for example, in the same manner as "5.2 Stretch test" of "JIS C 3216-3 Winding wires-Test methods-Part 3 Mechanical properties", and whether a float in the specimen after stretching is present or absent can be examined with the naked eye.

The assembled wire 1 of the present invention may be configured to transversely align the above-described assembled conductors 10 in multi-lines and to entirely cover them with both the adhesion layer 13 and the insulating outer layer 14. Even by such a multi-line configuration, the same performance as the single-line configuration can be obtained.

The assembled wire (rectangular wire) 1 of the present invention as described above is preferably applied to a coil, which constitutes motors of a hybrid vehicle or an electric vehicle, as an example of the electrical equipment. For example, the rectangular wire 1 can be used for a winding wire which forms a stator coil of the rotating electrical machine (motor) as described in JP-A-2007-259555. The constitution in which such an assembled wire of the present invention is stacked has an advantage that a current loss is minor even in the high-frequency region.

EXAMPLES

The present invention will be described in more detail based on examples given below, but the invention is not meant to be limited by these.

Example 1

A conductor strand 11 (see FIG. 1) was provided, which was made of copper of 0.85×3.2 mm (thickness×width) having chamfered four-cornered radius r=0.3 mm, and which had oxygen content of 15 ppm.

A polyethylene terephthalate (PET) film to be a layer of a thermoplastic resin to be used for the interlayer insulating layer 12 was applied onto, only one plane in the width (the transverse) direction of the conductor strand 11, to give the conductor strand 11. The thus-obtained conductor strand 11 was stacked with two layers in the thickness direction, to obtain the assembled conductor 10 (see FIG. 1). As the PET film, use was made of LUMILAR (registered trademark) manufactured by Toray Industries, Inc.

In formation of the adhesion layer 13, a polyetherimide (PEI) varnish was coated on the assembled conductor 10, with using a die having a shape similar to the shape of the assembled conductor 10. As PEI, use was made of trade name: ULTEM 1010, manufactured by SABIC Innovative Plastics Japan Co., Ltd. Then, the thus-coated assembled conductor 10 was got through an 8 m-length baking furnace set to 450° C. at the baking speed so that the baking time became 15 seconds. The polyetherimide varnish was prepared by dissolving the polyetherimide in N-methyl-2-pyrrolidone (NMP). At this one baking step, a polyetherimide layer with thickness 3 μm was formed. By adjusting a varnish concentration, the polyetherimide layer with thickness 3 μm was formed, to obtain the adhesion layer 13 with the 3 μm-thick coating layer.

With the assembled conductor 10 further having the adhesion layer 13 formed thereon, a layer (see FIG. 1) of the thermoplastic resin to be the above-described insulating outer layer 14 was formed on the outer periphery thereof by extrusion molding. As a screw of an extruder, a 30 mm full-flight screw, in which L/D=20 was used, and in which a compression ratio was set to 3. The extrusion was carried out using a polyetheretherketone (PEEK) as the thermoplastic resin, in accordance with the temperature conditions for extrusion, as shown in Table 1. As the PEEK, use was made of trade name: KITA SPIRE KT-820, manufactured by Solvay Specialty Polymers, relative permittivity 3.1, melting point 343° C. The cylinder temperature in the extruder was set to 3 zone temperatures of 300° C., 380° C., and 380° C., in this order from the input side of the resin. Further, a head temperature and a die temperature were set to 390° C. and 400° C., respectively. After extrusion-coating for the conductor strand 11 with the polyetheretherketone using an extruding die, the resultant conductor strand 11 was allowed to still stand for 10 seconds and then was cooled with water. Further, a 50 μm-thick insulating outer layer 14 of the thermoplastic resin was formed on the further outer periphery of the assembled conductor 10 having the adhesion layer 13 formed on the outer periphery thereof, to prepare an assembled wire 1 (see FIG. 1).

Examples 2 and 4

The assembled wire 1 was prepared in the same manner as in Example 1, except that the respective coating thickness of the interlayer insulating layer 12 or the insulating outer layer 14 was changed to the thickness as shown in Table 1.

Example 3

The assembled wire 1 was prepared in the same manner as in Example 1, except that the number of stacked layers of conductor strands 11 was made to be six, and that the respective coating thickness of the interlayer insulating layer 12 or the insulating outer layer 14 was changed to the thickness as shown in Table 1.

Example 5

The assembled wire 1 was prepared in the same manner as in Example 1, except that the respective coating thickness of the interlayer insulating layer 12, the adhesion layer 13, or the insulating outer layer 14 was changed to the thickness as shown in Table 1.

Example 6

The assembled wire 1 was prepared in the same manner as in Example 1, except that the interlayer insulating layer 12 was changed to be composed of polyethylene naphthalate (PEN), and that the respective coating thickness of the interlayer insulating layer 12, the adhesion layer 13, or the insulating outer layer 14 was changed to the thickness as shown in Table 1.

Example 7

The assembled wire 1 was prepared in the same manner as in Example 1, except that the interlayer insulating layer 12 was changed to be composed of polyetherimide (PEI), that the insulating outer layer 14 was changed to be composed of polyphenylenesulfide (PPS), that the adhesion layer 13 was changed to be composed of polyphenyl sulfone (PPSU), and that the respective coating thickness of the interlayer insulating layer 12, the adhesion layer 13, or the insulating outer layer 14 was changed to the thickness as shown in Table 1.

Example 8

The assembled wire 1 was prepared in the same manner as in Example 7, except that the number of stacked layers of conductor strands 11 was made to be six, that the interlayer insulating layer 12 was changed to be composed of polyamide 6T (PA6T), and that the coating thickness of the interlayer insulating layer 12 was changed to the thickness as shown in Table 1.

Example 9

The assembled wire 1 was prepared in the same manner as in Example 1, except that the interlayer insulating layer 12 was changed to be composed of polyamide 9T (PA9T), that the adhesion layer 13 was changed to be composed of polyethersulfone (PES), and that the respective coating thickness of the adhesion layer 13 or the insulating outer layer 14 was changed to the thickness as shown in Table 1.

Example 10

The assembled wire 1 was prepared in the same manner as in Example 1, except that the interlayer insulating layer 12 was changed to be composed of modified polyetheretherketone (modified PEEK).

Example 11

The assembled wire 1 was prepared in the same manner as in Example 1, except that the number of stacked layers of conductor strands 11 was made to be four.

Example 12

The assembled wire 1 was prepared in the same manner as in Example 7, except that the adhesion layer 13 was changed to be composed of phenyl sulfone (PSU).

Example 13

The assembled wire 1 was prepared in the same manner as in Example 1, except that the adhesion layer 13 was changed to be composed of polypropylene (PP), and that the respective coating thickness of the interlayer insulating layer 12 or the insulating outer layer 14 was changed to the thickness as shown in Table 1.

Example 14

The assembled wire 1 was prepared in the same manner as in Example 1, except that the interlayer insulating layer 12 was changed to be composed of thermoplastic polyimide.

Example 15

The assembled wire 1 was prepared in the same manner as in Example 1, except that the interlayer insulating layer 12 was changed to be composed of polypropylene (PP).

Example 16

The assembled wire 1 was prepared in the same manner as in Example 1, except that the insulating outer layer 14 was changed to be composed of polyamide 66 (PA66).

Example 17

The assembled wire 1 was prepared in the same manner as in Example 3, except that the adhesion layer 13 was changed to be divided into the following two layers, that the adhesion layer at the conductor strand 11 side was made to be composed of polyamide 9T (PA9T), that the adhesion layer at the insulating outer layer 14 side was made to be composed of polyetherimide (PEI), and that the respective coating thickness of these two adhesion layers was changed to the thickness as shown in Table 1.

Example 18

The assembled wire 1 was prepared in the same manner as in Example 2, except that the adhesion layer 13 was changed to be divided into the following two layers, that the adhesion layer at the conductor strand 11 side was made to be composed of polyamide 9T (PA9T), that the adhesion layer at the insulating outer layer 14 side was made to be composed of polyetherimide (PEI), and that the respective coating thickness of these two adhesion layers was changed to the thickness as shown in Table 1.

Example 19

The assembled wire 1 was prepared in the same manner as in Example 3, except that the interlayer insulating layer 12 was changed to be composed of polyamide 6T (PA6T), that the adhesion layer 13 was changed to be divided into two layers, that the adhesion layer at the conductor strand 11 side was made to be composed of polyamide 9T (PA9T), that the adhesion layer at the insulating outer layer 14 side was made to be composed of polyetherimide (PEI), and that the respective coating thickness of the interlayer insulating layer 12 and these two adhesion layers was changed to the thickness as shown in Table 1.

Example 20

The assembled wire 1 was prepared in the same manner as in Example 3, except that the adhesion layer 13 was changed to be divided into two layers, that the adhesion layer at the conductor strand 11 side was made to be composed of polyetherimide (PEI), that the adhesion layer at the insulating outer layer 14 side was made to be composed of polyethersulfone (PES), and that the respective coating thickness of the interlayer insulating layer 12, the insulating outer layer 14, and these two adhesion layers was changed to the thickness as shown in Table 1.

Comparative Examples 1 to 5

In Comparative Example 1, the assembled wire was prepared in the same manner as in Example 1, except that the interlayer insulating layer 12 was not provided.

In Comparative Example 2, the rectangle wire was prepared in the same manner as in Example 1, except that the number of stacked layers of conductor strands 11 was made to be seven.

In Comparative Example 3, the assembled wire was prepared in the same manner as in Example 1, except that the interlayer insulating layer was changed to be composed of polyamideimide (PAI), that the adhesion layer 13 was changed to be composed of polyphenyl sulfone (PPSU), and that the respective coating thickness of the interlayer insulating layer 12 or the adhesion layer 13 was changed to the thickness as shown in Table 1.

In Comparative Example 4, the assembled wire was prepared in the same manner as in Example 1, except that the adhesion layer 13 was not provided.

In Comparative Example 5, the assembled wire was prepared in the same manner as in Example 1, except that the thickness of the adhesion layer 13 was changed to 15 μm.

The following evaluations were conducted, on the assembled wires of Examples 1 to 20 and Comparative Examples 1 to 5, produced in these ways. The results of these evaluations are shown in Table 1.

(Welding Property)

The wire terminal was welded under the conditions of: welding current 30 A; and welding time 0.1 seconds, by generating arc discharge. When a welding ball arose at the wire terminal, the welding was judged as operable. On the other hand, when the welding ball did not arise but flowed, the welding was judged as inoperable. Further, when black soot generated on the periphery of the welded area, the welding was also judged as inoperable. That is:

As shown in FIG. 3(*a*), when there was no change in color on the periphery of the welded area of the assembled wire 1 and also a welding ball 5 arose at the terminal of the assembled wire 1, the welding was judged as being excellent and was rated as "A";

As shown in FIG. 3(*b*), although soot 6 generated on the periphery of the welded area of the assembled wire 1, when a welding ball 5 arose at the terminal of the assembled wire 1, the welding was judged as being good and was rated as "B";

As shown in FIG. 3(*c*), when there was no change in color on the periphery of the welded area of the assembled wire 1, but no welding ball 5 did arise at the terminal of the assembled wire 1, the welding was judged as being poor and was rated as "C"; and As shown in FIG. 3(*d*), when soot 6 generated on the periphery of the welded area of the assembled wire 1 and no welding ball 5 did arise at the terminal of the assembled wire 1, the welding was judged as being inoperable and was rated as "D".

The acceptance criterion is "A" or "B" judgment.

Note that the "the periphery of the welded area" means a range of about 5 mm in the line direction from the welded terminal.

(High-Frequency Property)

Under the conditions of 1,000 Hz, 2.16 A, and 138 Vrms, an AC magnetic field generator was put into operation, thereby generating AC magnetic field of 50 mT. When a sample is set in the magnetic field, heat generation due to eddy current is caused. The amount of heat generation at this time was measured and was defines as a current loss (W). A current loss $W_0$ was calculated, of the assembled wire in which a polyetheretherketone resin was extrusion-coated on a non-multilayered conductor, as described above.

When the ratio of current losses W and $W_0$ of each sample was 0.8 or less (inhibition ratio of the current loss is 20% or more), high-frequency property was judged as being good and rated as "B". Further, when the ratio is 0.4 or less (inhibition ratio of the current loss is 60% or more), high-frequency property was judged as being excellent and rated as "A". On the other hand, when the ratio is more than 0.8 (inhibition ratio of the current loss is less than 20%), high-frequency property was judged as being poor and rated as "D".

$P=EI\cos\phi$ In this regard, $\phi=\tan^{-1}(Ls\cdot 2\pi f/Rs)$

E (V): Measured value of input voltage

Ls (H): Measured value of inductance

I (A): Measured value of input current

Rs (Ω): Measured value of resistance (Molding Property)

With regard to the assembled wire 1 formed by extrusion-coating the adhesion layer 13, the insulating outer layer 14, and the like on the assembled conductor 10, the cross-section thereof was cut and observed. At this time, the cross-section was checked for a tilt and a misalignment of the multilayer. With regard to the tilt, whether the angle to the direction of the multilayer to be stacked is nothing was checked. Further, with regard to the misalignment, evaluation was conducted in accordance with the criteria shown in FIGS. 4(*a*) to 4(*d*). In the case of the conductor strand 11 to be stacked in the thickness direction, whether a misalignment of ⅓ or more of the length of width is nothing was checked, with respect to not only conductors adjacent to each other but also conductors in which a misalignment between them is largest. When such a tilt and misalignment were less than ⅓n of the length of width, the molding property was judged as being at an acceptable level and was rated as "A", "B", or "C". On the other hand, when such a tilt and misalignment existed, the molding property was judged as being poor and was rated as "D". That is:

As shown in FIG. 4(*a*), when the conductor strands 11 constituting the assembled conductor 10 were stacked in the thickness direction, the misalignment in the transverse direction of the conductor strand(s) 11 having the largest misalignment was the length of less than 1/10 of the width W, the molding property was judged as being excellent and was rated as "A";

As shown in FIG. 4(*b*), when the conductor strands 11 constituting the assembled conductor 10 were stacked in the thickness direction, the misalignment in the transverse direction of the conductor strand(s) 11 having the largest misalignment was the length of 1/10 or more and less than ⅕ of the width W, the molding property was judged as being good and was rated as "B";

As shown in FIG. 4(*c*), when the rectangular wires 4 constituting the multilayer conductor member 3 were stacked in the thickness direction, the misalignment in the transverse direction of the rectangular wire 4 having the largest misalignment was the length of ⅕ or more and less than ⅓ of the width W, the molding property was judged as being in an acceptable range and was rated as "C"; and As shown in FIG. 4(*d*), when the conductor strands 11 constituting the assembled conductor 10 were stacked in the thickness direction, the misalignment in the transverse direction of the conductor strand(s) 11 having the largest misalignment was the length of ⅓ or more of the width W, the molding property was judged as being poor and was rated as "D".

The acceptance criterion is "A", "B", or "C" judgment.

Note that, in FIGS. 4(*a*) to 4(*d*), each of which is a diagrammatic representation in which the interlayer insulating layer 12 was omitted.

(Bending Workability Test (Adhesiveness Test))

The adhesiveness between the assembled conductor 10 and the insulating outer layer 14 in the assembled wire 1 was evaluated, through the following bending workability test.

A 300 mm-long straight specimen was cut out of each of the produced assembled wires 1. A scratch (incision) of about 5 μm in depth and 50 μm in length was put, on a central part of the insulating outer layer 14 at the edge face of this straight specimen, using a dedicated jig, respectively, in both the longitudinal direction and the vertical direction. In this instance, the insulating outer Layer 14 and the assembled conductor 10 adhere to each other through the adhesion layer 13, which were not peeled off each other. Herein, the edge face means a face that is axially formed in a row by a lateral side (thickness, a side along the vertical direction in the drawing of FIGS. 1 and 2) in the cross-sectional shape of the rectangle-shaped assembled wire 1. Thus, the scratch was provided at either one of right- or left-side of the assembled wire 1 shown in FIGS. 1 and 2.

The straight specimen with this scratch at the top was bent centering on the iron core having a diameter of 1.0 mm at 180° (in a U-shape), and this state was continued for 5 minutes. Progression of peeling off of the assembled conductor 10 from the insulating outer layer 14 occurred near the top of the straight specimen was observed with the naked eye.

In this test, the case where the scratch formed in any of the longitudinal direction and the vertical direction of the insulating outer layer 14 did not spread and the insulating outer layer 14 was not peeled off from the assembled conductor 10, was judged as "acceptance" and was rated as "A". The case where the scratch formed in at least one of the longitudinal direction and the vertical direction of the insulating outer layer 14 spread and the insulating outer layer 14 was peeled off entirely from, for example, the assembled conductor 10, was judged as "failure" and was rated as "D".

TABLE 1

| | | Ex 1 | Ex 2 | Ex 3 | Ex 4 | Ex 5 | Ex 6 | Ex 7 | Ex 8 |
|---|---|---|---|---|---|---|---|---|---|
| Assembled wire | Kind | Cu | Cu | Cu | Cu | Cu | Cu | Cu | Cu |
| | The number of stacked layers | 2 | 2 | 6 | 2 | 2 | 2 | 2 | 6 |
| Interlayer insulating layer | Kind | PET | PET | PET | PET | PET | PEN | PEI | PA6T |
| | Coating thickness (μm) | 50 | 75 | 10 | 100 | 25 | 10 | 25 | 15 |
| Insulating outer layer | Kind | PEEK | PEEK | PEEK | PEEK | PEEK | PEEK | PPS | PPS |
| | Coating thickness (μm) | 100 | 150 | 120 | 250 | 120 | 150 | 120 | 120 |
| Adhesion layer | Kind | PEI | PEI | PEI | PEI | PEI | PEI | PPSU | PPSU |
| | Coating thickness (μm) | 3 | 3 | 3 | 3 | 10 | 5 | 10 | 10 |
| Welding property | | A | B | A | B | A | A | A | A |
| High-frequency property | | B | B | A | B | B | B | B | A |
| Molding property | | B | B | B | B | A | B | A | B |
| Bending workability | | A | A | A | A | A | A | A | A |

| | | Ex 9 | Ex 10 | Ex 11 | Ex 12 | Ex 13 | Ex 14 | Ex 15 | Ex 16 |
|---|---|---|---|---|---|---|---|---|---|
| Assembled wire | Kind | Cu | Cu | Cu | Cu | Cu | Cu | Cu | Cu |
| | The number of stacked layers | 2 | 2 | 4 | 2 | 2 | 2 | 2 | 2 |
| Interlayer insulating layer | Kind | PA9T | PET | PET | PEI | PET | Thermoplastic polyimide | PP | PET |
| | Coating thickness (μm) | 50 | 50 | 50 | 25 | 25 | 50 | 50 | 50 |
| Insulating outer layer | Kind | PEEK | Modified PEEK | PEEK | PPS | PEEK | PEEK | PEEK | PA66 |
| | Coating thickness (μm) | 150 | 100 | 100 | 120 | 120 | 100 | 100 | 100 |
| Adhesion layer | Kind | PES | PEI | PEI | PSU | PP | PEI | PEI | PEI |
| | Coating thickness (μm) | 5 | 3 | 3 | 10 | 10 | 3 | 3 | 3 |
| Welding property | | A | A | A | A | A | B | B | A |
| High-frequency property | | B | B | A | B | B | B | B | B |
| Molding property | | A | A | B | B | B | B | B | B |
| Bending workability | | A | A | A | A | A | A | A | A |

| | | Ex 17 | Ex 18 | Ex 19 | Ex 20 |
|---|---|---|---|---|---|
| Assembled wire | Kind | Cu | Cu | Cu | Cu |
| | The number of stacked layers | 6 | 2 | 6 | 2 |
| Interlayer insulating layer | Kind | PET | PET | PA6T | PET |
| | Coating thickness (μm) | 10 | 75 | 15 | 100 |
| Insulating outer layer | Kind | PEEK | PEEK | PEEK | PEEK |
| | Coating thickness (μm) | 120 | 150 | 120 | 250 |
| Adhesion layer (at the side contacting the conductor) | Kind | PA9T | PA9T | PA9T | PEI |
| | Coating thickness (μm) | 3 | 5 | 5 | 3 |
| Adhesion layer (at the side contacting the insulating outer layer) | Kind | PEI | PEI | PPSU | PES |
| | Coating thickness (μm) | 3 | 5 | 5 | 3 |
| Welding property | | A | A | A | B |
| High-frequency property | | A | B | A | B |
| Molding property | | A | A | A | A |
| Bending workability | | A | A | A | A |

TABLE 1-continued

| | | CEx 1 | CEx 2 | CEx 3 | CEx 4 | CEx 5 |
|---|---|---|---|---|---|---|
| Assembled wire | Kind | Cu | Cu | Cu | Cu | Cu |
| | The number of stacked layers | 1 | 7 | 2 | 2 | 2 |
| Interlayer insulating layer | Kind | — | PET | PAI | PET | PET |
| | Coating thickness (μm) | — | 50 | 50 | 50 | 50 |
| Insulating outer layer | Kind | PEEK | PEEK | PEEK | PEEK | PEEK |
| | Coating thickness (μm) | 100 | 150 | 120 | 100 | 100 |
| Adhesion layer | Kind | PEI | PEI | PPSU | — | PEI |
| | Coating thickness (μm) | 5 | 3 | 10 | — | 15 |
| Welding property | | A | A | D | A | A |
| High-frequency property | | D | A | B | B | B |
| Molding property | | A | D | A | D | D |
| Bending workability | | A | A | A | D | A |

'Ex' means Example according to this invention.
'CEx' means Comparative Example.

As is shown in Table 1, it was found that Examples 1 to 20 are each excellent in everything with respect to weldability, high-frequency property, molding property, and bending workability. In the forgoing Examples 1 to 20, in a case where the thickness of the interlayer insulating layer is more than 50 μm and 100 μm or less, the evaluation of weldability became "B". In a case where the thickness of the interlayer insulating layer is 10 μm or more and 50 μm or less, the evaluation of weldability resulted in "A" or "B". Further, in a case where the number of stacked layers of the conductor strands 11 was two, the evaluation of high-frequency property became "B", while in a case where the number of stacked layers of the conductor strands 11 was three or more, the evaluation of high-frequency property became "A". Furthermore, in a case where the thickness of the adhesion layer is 3 μm or more and 10 μm or less, misalignment in the transverse direction of the conductor strand 11 was minor and the evaluation of molding property became "A" or "B". Furthermore, in all of Examples having an adhesion layer, the evaluation of bending workability became "A".

In contrast, in Comparative Example 1 in which the number of stacked layers of the conductor strands 11 was one, the evaluation of high-frequency property was "D". In Comparative Example 2 in which the number of stacked layers of the conductor strands 11 was too many, the evaluation of molding property was "D". Further, in Comparative Example 3 for which the interlayer insulating layer was composed of not any thermoplastic resin, but a thermosetting resin of polyamideimide (PAI), any welding ball was not formed and soot was occurred on the periphery of the welded place. For this reason, the evaluation of weldability was "D". Further, in Comparative Examples 4 and 5 in which the adhesion layer was not provided or was too thick, misalignment in the transverse direction of the conductor strands 11 became too large, and the evaluation of molding property was "D". Furthermore, in Comparative Examples 1 to 3, and 5 having the adhesion layer, the evaluation of bending workability was excellent as high as "A". However, in Comparative Example 4 without any adhesion layer, the evaluation of bending workability became "D", because the insulating outer layer was peeled off from the conductor strands.

Having described our invention as related to the present embodiments and examples, it is our intention that the invention not be limited by any of the details of the description, unless otherwise specified, but rather be construed broadly within its spirit and scope as set out in the accompanying claims.

This application claims priority on Patent Application No. 2015-227868 filed in Japan on Nov. 20, 2015, which is entirely herein incorporated by reference.

REFERENCE SIGNS LIST

1 Assembled wire
10 Assembled conductor
11 Conductor strand
12 Interlayer insulating layer
13, 13A, 13B Adhesion layer
14 Insulating outer layer

The invention claimed is:

1. A high-frequency assembled wire, comprising:

an assembled conductor composed of a plurality of conductor strands each having a rectangular cross-section, stacked and arranged each other across an interlayer insulating layer;

an insulating outer layer that coats the assembled conductor including the interlayer insulating layer; and an adhesion layer comprising a thermoplastic resin having a thickness of 3 μm or more and 8 μm or less between the assembled conductor and the insulating outer layer, wherein the adhesion layer is composed of a resin comprising polyetherimide, polyethersulfone, or polyphenyl sulfone, and the interlayer insulating layer is composed of a resin comprising polyethylene terephthalate, polyethylene naphthalate, polyamide 6T, or polyamide 9T, and the insulating outer layer is composed of a resin comprising a thermoplastic resin having a melting point of 270° C. or more selected from polyphenylenesulfide, polyetheretherketone, modified polyetheretherketone, or thermoplastic polyimide.

2. The high-frequency assembled wire according to claim 1, wherein the resin of the adhesion layer comprises a thermoplastic resin having a tensile modulus at 250° C. of 10 MPa or more and 1,000 MPa or less.

3. The high-frequency assembled wire according to claim 1, wherein the adhesion layer is comprised of a single layer or a plurality of layers.

4. The high-frequency assembled wire according to claim 1, wherein the interlayer insulating layer is composed of a thermoplastic resin having a melting point of 250° C. or more and 350° C. or less.

5. The high-frequency assembled wire according to claim 1, wherein the number of stacked layers of conductor strands is two layers or more and six layers or less.

6. A method of producing a high-frequency assembled wire according to claim 1, comprising:

a step of forming an assembled conductor, by stacking, in a thickness direction, each of conductor strands having a rectangular cross-section and having an interlayer insulating layer of a thermoplastic resin of an amorphous resin having no melting point or a thermoplastic resin of a crystalline resin having an amide bond, formed on one side thereof by performing bake-finishing;

a step of coating an adhesion layer of a thermoplastic resin on the outer periphery of the assembled conductor; and a step of coating an insulating outer layer on the outer periphery of the adhesion layer, wherein, before coating the insulating outer layer, the adhesion layer, which has a thickness of 3 μm or more and 10 μm or less, is formed on the outer periphery of the assembled conductor.

7. An electrical equipment, having wirings, wherein at least a part of the wirings comprises high-frequency assembled wire according to claim 1.

* * * * *